United States Patent [19]

Knitter et al.

[11] 4,364,742

[45] Dec. 21, 1982

[54] CARBONACEOUS MATERIALS IN OIL SLURRIES

[75] Inventors: Kathy A. Knitter, Morristown; Jose' L. Villa, Bridgewater, both of N.J.

[73] Assignee: Diamond Shamrock Corporation, Dallas, Tex.

[21] Appl. No.: 250,018

[22] Filed: Apr. 1, 1981

[51] Int. Cl.[3] ..... C10L 1/32

[52] U.S. Cl. ..... 44/51; 44/63

[58] Field of Search ..... 44/51, 63

[56] References Cited

U.S. PATENT DOCUMENTS

| | | | |
|---|---|---|---|
| 3,210,168 | 10/1965 | Morway | 44/51 |
| 4,069,022 | 1/1978 | Metzger | 44/51 |
| 4,147,519 | 4/1979 | Sawyer, Jr. | 44/51 |
| 4,201,552 | 5/1980 | Rowell et al. | 44/51 |
| 4,251,230 | 2/1981 | Sawyer, Jr. | 44/51 |

OTHER PUBLICATIONS

Schwartz et al., Surface Active Agents, vol. I, Interscience Publishers Inc., New York, 1949, pp. 194–196, 216–217.

*Primary Examiner*—Jacqueline V. Howard
*Attorney, Agent, or Firm*—Leslie G. Nunn, Jr.

[57] ABSTRACT

Mixtures of an imidazoline quaternary salt and a nitrogen base having from zero to nine carbon atoms are added to oil slurries of solid particulate carbonaceous material such as a coal oil mixture (COM) or a coke oil mixture to stabilize the slurry during storage and dispensing at various temperatures. The stabilizer mixtures of imidazoline quaternary salt and nitrogen base are added to either the oil or slurry (or during the grinding of the carbonaceous material) and are effective with or without the addition of water. Coal/coke oil slurries may contain from about 40 to about 90 parts by weight of oil, about 10 to about 60 parts by weight of powdered coal or coke, about 0.01 to about 6.0 parts by weight of the stabilizer mixture and about 0 to about 10 parts by weight of water. Useful stabilizer mixtures include a mixture of from about 99% to about 75% by weight of an imidazoline quaternary salt which is a reaction product of oleic acid, aminoethylethanolamine and diethyl sulfate and from about 1% to about 25% by weight of a nitrogen base such as urea.

10 Claims, No Drawings

CARBONACEOUS MATERIALS IN OIL SLURRIES

BACKGROUND OF THE INVENTION

1. Field of the Invention

This invention relates to carbonaceous materials in oil slurries and more particularly to stabilized coal or coke in oil slurries containing mixtures of imidazoline quaternary salts and a nitrogen base having from zero to nine carbon atoms as stabilizers.

2. Description of the Prior Art

Addition of solid particulate carbonaceous material, such as coal or coke, to a liquid hydrocarbon fuel, such as fuel oil, has been studied for many years. In the past five years, and particularly during the last two years, importance of reducing dependency of the world upon natural gas and liquid hydrocarbon fuels for its energy has been dramatically demonstrated.

Though not providing a complete solution to this energy problem, attempts have been made to incorporate solid particulate carbonaceous material, such as coal and coke, in liquid hydrocarbon fuels, because these particulate carbonaceous materials are far more plentiful than liquid fuels. There is considerable interest in extending and/or supplementing liquid fuels with solid fuels.

Many large industrial fuel users have equipment which was designed and constructed for the transportation, storage and combustion of liquid fuels. As yet, solid-liquid slurries, suspensions or emulsions are not accepted for regular use in such conventional equipment. In some instances this equipment was converted from its original design for burning solid fuels to liquid fuels. Many believe this trend should be reversed.

Various solutions to the problem of combining a solid particulate carbonaceous material with a liquid hydrocarbon fuel have been explored. One solution involved grinding carbonaceous material to colloidal size before introducing it into an oil. Even though this solution was successful, grinding costs were prohibitive. Coal oil slurries tend to form gels when heated to usable temperatures during storage, usually thixotropic gels.

Attempts were made to use the gelling phenomenon to hold larger than colloidal size particles in suspension. The gel was later broken down by adding additional oil so that the resulting slurry was pumpable without particulate material settling out. Inherently, this procedure was an expensive batch process.

Various materials were also added in an attempt to stabilize a coal oil slurry against settling of larger than colloidal size coal particles. Lime-rosin and starch were added to prevent settling of the larger slurry particles. Casein, gelatin and rubber were also added as suspension stabilizing agents to inhibit settling of coal particles. It was found that these suspension stabilizing agents must be added in quantities which undesirably thicken and increase viscosity of the slurry in order to prevent substantial quantities of coal particulate material from settling. Increasing slurry viscosity not only reduced the settling problem, but also limited uses to which the slurry may be put.

U.S. Pat. No. 4,069,022—Metzger, issued Jan. 17, 1978, describes a substantially water-free, high solid content, stable and combustible fuel slurry of about 5 to about 50 weight percent of a solid particulate carbonaceous material with the balance of the slurry being a liquid hydrocarbon fuel, a slurry suspension stabilizing agent and a water-free slurry viscosity reducing agent.

The viscosity reducing agent was present in an amount sufficient to maintain the slurry at a viscosity below about 300 seconds Saybolt Universal when the slurry is at a temperature of 175° F. Preferably, the viscosity reducing agent was a soap and the suspension stabilizing agent was starch.

The process for preventing formation of a gel in and controlling the settling and viscosity of this slurry involved the step of adding to the slurry containing a suspension stabilizing agent, a soap or salt of a fatty acid in an amount sufficient to maintain the viscosity of the slurry below 300 seconds Saybolt Universal when the slurry temperature was 175° F.

U.S. Pat. No. 3,210,168—Morway, issued Oct. 5, 1965, describes a stabilized slurry of pulverized coal coated with a liquid hydrocarbon fuel in water to make the slurry pumpable through a pipeline. The slurry is stabilized with an imidazoline surfactant having the formula:

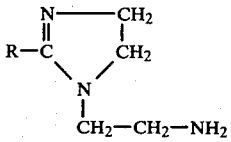

where R is an aliphatic hydrocarbon chain radical containing from 10 to 23 carbon atoms.

U.S. Pat. No. 4,201,552—Rowell et al, issued May 6, 1980, describe coal oil slurries stabilized with certain cationic surfactants having the group $$>N-CH_2-CH_2-O-$$

where the group forms part of a straight chain such as Ethomeen® C-20 or cyclic ring such as N-soya-N-ethyl morpholinium ethosulfate.

SUMMARY OF THE INVENTION

Mixtures of imidazoline quarternary salts and a nitrogen base having from zero to nine carbon atoms are added to carbonaceous materials in oil slurries such as a coal oil mixture (COM) or a coke oil mixture in an amount sufficient to stabilize slurries during storage and dispersing at various temperatures. The stabilizer mixtures are added to either the oil or slurry (or during grinding of the carbonaceous material) and are effective with or without addition of water. Coal/coke oil slurries may contain from about 40 to about 90 parts by weight of oil, about 10 to about 60 parts by weight of powdered coal or coke, about 0.01 to about 6.0 parts by weight of the stabilizer mixture and about 0 to about 10 parts by weight of water. Useful stabilizer mixtures include a mixture of from about 99% to about 75% by weight of an imidazoline quaternary salt which is a reaction product of oleic acid, aminoethylethanolamine and diethyl sulfate and from about 1% to about 25% by weight of a nitrogen base such as urea.

DETAILED DESCRIPTION

Stabilizer mixtures may contain from about 99% to about 25% by weight of 1-hydroxyalkyl 2-hydrocarbyl imidazoline quaternary salts having the formula:

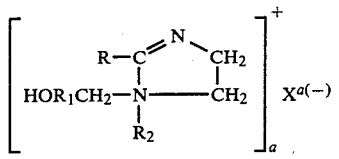

wherein:

R is a hydrocarbon radical having 9 to 23 carbon atoms, $R_1$ is a $$-CH_2- \text{ or } -\overset{CH_3}{\overset{|}{C}}H- \text{ radical,}$$

$R_2$ is hydrogen, an unsubstituted or hydroxy-substituted aliphatic hydrocarbon radical having 1 to 6 carbon atoms or a benzyl radical, X is a water-soluble anion, and a is a number equal to the ionic valence of the anion, X.

Compounds of this general formula are known and may be made by quaternarizing (e.g. with a $C_1$–$C_6$ hydrocarbon or benzyl halide or sulfate) an imidazoline produced by the dehydration cyclization of an amide resulting from the reaction of a $C_{10}$ to $C_{24}$ aliphatic hydrocarbonoic acid and either 2-hydroxyethyl ethylene diamine or 2-hydroxyisopropyl ethylene diamine as described in U.S. Pat. Nos. 2,268,273 and 3,669,608.

In the imidazoline compounds used in this process, the $C_9$–$C_{23}$ aliphatic hydrocarbon radical, R, may be: saturated or unsaturated; linear, branched, or cyclic; and comprised of a mixture of the $C_9$–$C_{23}$ hydrocarbons. Illustrative of acids that may be used in producing the compounds and form the hydrocarbon radical thereof are lauric, palmitic, stearic, erucic, oleic, linoleic, linolenic and tallow acids. As will be appreciated, the commercial technical grades of these and other acids, which may be used to produce the imidazoline compounds by the exemplary process hereinbefore described, normally contain considerable minor quantities of hydrocarbons outside the $C_9$ to $C_{23}$ range, and that, therefore, the imidazoline compounds prepared from such acids and used in the invention process may contain minor quantities of compounds having 2-hydrocarbyl groups having less than 9 carbons or more than 23 carbons.

$R_2$ is any unsubstituted or hydroxysubstituted hydrocarbon radical having 1 to 6 carbon atoms that is linear, branched, or cyclic, and either saturated or unsaturated, or may be a benzyl radical when the imidazoline compounds used are produced by quaternarization as for example, with a $C_1$–$C_6$ hydrocarbon or benzyl halide or sulfate or with an active epoxide such as ethylene or propylene oxide.

The anion, X, is not critical and may be $$Cl^-,\ Br^-,\ CH_3COO^-,\ C_2H_5SO_4^-,\ CH_3SO_4^-$$

or like anion. Generally preferred, because of their lower costs, are the chloride, methosulfate and ethosulfate anions.

Nitrogen containing bases having from zero to nine carbon atoms constitute the balance of the stabilizer mixture. Stabilizer mixtures may contain from about 1% to about 25% by weight of the nitrogen containing bases.

Nitrogen containing bases having from zero to nine carbon atoms include ammonia, ammonium hydroxide, urea, diethanolamine, triethanolamine, aniline, methylamine, dimethylamine, trimethylamine, ethylamine, diethylamine, triethylamine, propylamine, dipropylamine, tripropylamine, monoethanolamine, monopropanolamine, dipropanolamine, tripropanolamine, their isomers, their mixtures and the like. Thiourea as well as other amino bases such as dicyandiamide, ammeline, guanamines, guanidine, melamine and the like may also be used.

Stabilizer mixtures contain from about 99% to about 75% by weight of an imidazoline quaternary salt and from about 1 % to about 25% by a nitrogen containing base. These mixtures are prepared by blending the desired quantities of imidazoline quaternary salt and nitrogen containing base until uniform and then adding the mixture to either the oil or slurry (or during grinding of the carbonaceous material). Sufficient mixture is added to stabilize the oil slurry during storage and dispersing at elevated temperatures.

The term "carbonaceous," as used herein, encompasses solid particulate carbonaceous fossil fuel materials which have been powdered or pulverized to a size where 70% to 90% or more passes through a 200 mesh screen. Useful carbonaceous materials include bituminuous and anthracite coals, coke, petroleum coke, lignite, charcoal, peat, admixtures thereof and the like. The teachings relating to these materials, oils and carbonaceous oil slurries in U.S. Pat. No. 4,069,022—Metzger, issued Jan. 17, 1978, are incorporated by reference herein.

Oils suitable for these slurries include fuel oils such as No. 6 fuel oil, No. 2 fuel oil as well as other liquid petroleum products such as gas oils and crude oils used as fuel oils or the like.

Powdered coal used in these slurries may be pulverized bituminous, anthracite, or semi-bituminous coal. If desired, finely-divided solid carbonaceous materials such as powdered coke from coal or petroleum may be used in these slurries.

At room temperature, when a uniformly mixed coal oil slurry or coke oil slurry is prepared, the viscous fuel oil usually holds powdered coal in suspension. Later, when the coal oil slurry is heated so that the slurry can be pumped, the oil viscosity decreases and coal particles tend to settle. The quantity of dispersant added initially to the coal oil slurry should be sufficient to keep the coal particles suspended at elevated temperatures. To test the stabilizing effect of various additives, coal oil mixtures are prepared and then heat aged. The following procedure may be used to evaluate coal oil and coke oil slurries containing the stabilizer mixtures described above.

APPARATUS

1. One gallon jars with lids.
2. High speed laboratory stirrer.
3. Glass rod.
4. Glass jars with lids, 4 oz.
5. Constant temperature bath.

REAGENTS

1. Fuel Oil No. 6.
2. Powdered coal 70 to 90% through 200 mesh.

PROCEDURE

1. Prepare a uniform coal in oil mixture in a one gallon jar. Disperse coal into heated oil kept between 55°–70° C. using agitation with a laboratory high speed stirrer. Agitation should continue until no lumps of coal are present in the mixture.

2. Repeat 1 using different coal to oil ratios to encompass the range of 90 oil/10 coal to 40 oil/60 coal.
3. Weigh aliquots of 100 g of coal in oil mixtures into 4 oz jars.
4. Add desired amount of stabilizer to each 100 g of coal in oil mixture. Seal system by tightly closing lid. Preferred level of addition for screening purposes is 0.5 g of stabilizer per 100 g of coal in oil mixture, i.e., 0.5 pph (0.5 part per hundred by weight). Thus, test a series of stabilizers simultaneously.
5. Place all jars into a constant temperature oven kept at designated temperature and age samples.
6. Check settling of coal to bottom of the jar every 24 hours. If coal has settled to the bottom of the jar, reject the stabilizer and proceed aging with the remaining jars.
7. Check the degree of settling of coal to the bottom of the jar by slowly inserting a glass rod into the coal in oil mixture until it penetrates any sediment and hits the bottom of the jar. If the rod slides uninhibited by any coal sediment to the bottom of the jar, the stabilizer is acceptable. However, if the penetration of the rod is retarded by thickening of the mixture at the bottom of the jar or by a coal sediment at the bottom of the jar, the stabilizer should be rejected.

For a fuller understanding of the nature and advantages of this invention, reference may be made to the following examples. These examples are given merely to illustrate the invention and are not to be construed in a limiting sense. All quantities, proportions and percentages are by weight and all references to temperature are °C. unless otherwise indicated.

EXAMPLE I

Coal oil slurries were stabilized with stabilizer (A) a quaternarized imidazoline (control) which was a reaction product of oleic acid, aminoethylethanolamine and diethyl sulfate, stabilizer (B) a mixture of 90% by weight of the quaternarized imidazoline and 10% by weight of urea and stabilizer (C) a mixture of 90% by weight imidazoline quaternary salt and 10% by weight of triethanolamine.

The coal oil slurries were prepared using 40% by weight of powdered coal of which 80% passed through a 200 mesh sieve, 59.75% by weight of fuel oil No. 6 low viscosity having a Saybolt viscosity of 26 seconds at 122° F. and 0.25 pph (parts per hundred by weight) of stabilizer (A), (B) or (C). The Blank was a slurry containing 40% by weight powdered coal, 60% by weight fuel oil and 0.0 pph of stabilizer. Slurry samples were tested using the evaluation procedure described above in the specification.

Samples of each stabilized coal oil slurry were placed in an oven at 65° and aged 7 days to accelerate sedimentation of coal particles. Sedimentation of each slurry sample was checked by slowly inserting a glass rod into the coal oil slurry until it penetrated any sediment and touched the bottom of the jar.

| Stabilizer | Stability after 7 days at 65° C. |
|---|---|
| A (control) | slight sediment |

-continued

| Stabilizer | Stability after 7 days at 65° C. |
|---|---|
| B | good |
| C | good |
| Blank | packed sediment within 2 days |

EXAMPLE II

Coal oil slurries were prepared using 50% by weight of powdered coal of which 80% passed through a 200 mesh sieve, 48% by weight of Indonesian fuel oil waxy crude No. 6 with high pour point, 2% by weight water and 0 or 1.0 pph (parts per hundred by weight) of stabilizer. (A), (B), (C) as described in Example I, or (D), a mixture of 95% by weight imidazoline quaternary salt and 5% by weight urea. When 1.0 pph of stabilizer was added, the quantity of fuel oil in the slurry was reduced from 48% by weight to 47% by weight. These slurries were tested using the evaluation procedure described in the specification.

Samples of the stabilized coal oil slurries were placed in an oven at 65°–70° C. and aged 7 days to accelerate sedimentation of coal particles. Sedimentation of each slurry was checked very slowly by inserting a glass rod into the coal oil slurry until it penetrates any sediment and touches the bottom of the jar.

| Stabilizer | Stability after 7 days at 65°–70° C. |
|---|---|
| A (control) | thick; some sediment |
| B | good |
| C | good |
| D | good |
| Blank | failed at day 2 |

The Blank was 50% by weight of powdered coal, 48% by weight of fuel oil and 2% by weight of water and 0 pph of stabilizer.

EXAMPLE III

The coal oil slurries were prepared using 40% by weight of powdered coal of which 80% passed through a 200 mesh sieve, 56% by weight of fuel oil No. 6 low viscosity having a Saybolt viscosity of 26 seconds at 122° F. and 4% water. Stabilizers (A), (B), (D), (E) a mixture of 80% by weight imidazoline quaternary salt and 20% aniline, (F) a mixture of 80% by weight imidazoline quaternary salt and 20% triethanolamine, (G) a mixture of 80% by weight imidazoline quaternary salt and 20% ammonium hydroxide and (H) a mixture of 90% by weight imidazoline quaternary salt and 10% diethanolamine were added to the slurry at 0.50 pph. When 0.50 pph of stabilizer was added, the quantity of fuel oil in the slurry was reduced from 56% by weight to 55.5% by weight.

Samples of the stabilized coal oil slurries were placed in an oven at 70° C. and aged 7 days to accelerate sedimentation of coal particles. Sedimentation of each slurry was checked by slowly inserting a glass rod into the coal oil slurry until it penetrates any sediment and touches the bottom of the jar.

| Stabilizer | Stability after 7 days at 70° C. |
|---|---|
| Blank - no stabilizer | failed at day 2 |

-continued

| Stabilizer | Stability after 7 days at 70° C. |
|---|---|
| A | sediment |
| B | good; slight redispersible sediment |
| D | good; slight redispersible sediment |
| E | good; slight redispersible sediment |
| F | sediment |
| G | good; slight redispersible sediment |
| H | good; slight redispersible sediment |

While the invention has been described with reference to certain specific embodiments thereof, it is understood that it is not to be so limited since alterations and changes may be made therein which are within the full and intended scope of the appended claims.

What is claimed is:

1. An oil slurry of solid particulate carbonaceous material having a mixture of (a) from about 99% to about 75% by weight of an imidazoline quaternary salt of the formula

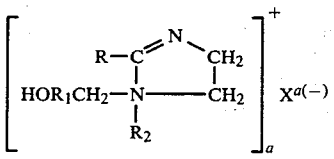

wherein:

R is a hydrocarbon radical having 9 to 23 carbon atoms, $R_1$ is a $$-CH_2- \text{ or } -\overset{CH_3}{\overset{|}{CH}}- \text{ radical,}$$

$R_2$ is hydrogen, an unsubstituted aliphatic hydrocarbon radical having 1 to 6 carbon atoms, a hydroxy-substituted aliphatic hydrocarbon radical having 1 to 6 carbon atoms or a benzyl radical, X is a water-soluble anion, and a is a number equal to the ionic valence of the anion, X, and (b) from about 1% to about 25% by weight of a nitrogen base having from 0 to 9 carbon atoms, the mixture being present in an amount sufficient to stabilize the slurry at elevated temperatures.

2. The slurry of claim 1 wherein the nitrogen base is selected from the group consisting of ammonia, an amine having one to nine carbon atoms, an alkanolamine having one to nine carbon atoms and an amino base.

3. The slurry of claim 2 wherein the amino base is selected from the group consisting of urea, thiourea, dicyandiamide, ammeline, guanamines, guanidine and melamine.

4. The slurry of claim 1 wherein powdered coal is present.

5. The slurry of claim 1 wherein powdered coke is present.

6. The slurry of claim 1 wherein there is present from about 40 to about 90 parts by weight of oil, about 10 to about 60 parts by weight of particulate carbonaceous material, about 0 to about 10 parts by weight of water and about 0.01 to about 6 parts by weight of the mixture of imidazoline quaternary salt and nitrogen base.

7. The slurry of claim 1 wherein the quaternary salt is a reaction product of oleic acid, aminoethylethanolamine and diethyl sulfate and the nitrogen containing base is urea.

8. The slurry of claim 1 wherein the quaternary salt is a reaction product of oleic acid, aminoethylethanolamine and diethyl sulfate and the nitrogen containing base is triethanolamine.

9. The slurry of claim 1 wherein the quaternary salt is a reaction product of oleic acid, aminoethylethanolamine and diethyl sulfate and the nitrogen containing base is diethanolamine.

10. The slurry of claim 1 wherein the quaternary salt is a reaction product of oleic acid, aminoethylethanolamine and diethyl sulfate and the nitrogen containing base is ammonium hydroxide.

* * * * *